United States Patent [19]

Takao et al.

[11] Patent Number: 4,725,954

[45] Date of Patent: Feb. 16, 1988

[54] APPARATUS AND METHOD FOR CONTROLLING FUEL SUPPLY TO INTERNAL COMBUSTION ENGINE

[75] Inventors: Mitsunori Takao, Kariya; Takahiko Kimura, Nagoya, both of Japan

[73] Assignee: Nippondenso Co., Ltd., Kariya, Japan

[21] Appl. No.: 714,861

[22] Filed: Mar. 22, 1985

[30] Foreign Application Priority Data

Mar. 23, 1984 [JP] Japan ..... 59-57131
Mar. 23, 1984 [JP] Japan ..... 59-57132

[51] Int. Cl.[4] ..... F02M 51/00

[52] U.S. Cl. ..... 364/431.07; 123/492; 364/431.05

[58] Field of Search ..... 364/431.07, 431.05; 123/492, 493

[56] References Cited

U.S. PATENT DOCUMENTS 4,457,283 7/1984 Kobayashi et al. ..... 123/492
4,463,730 8/1984 Kishi ..... 364/431.07
4,490,792 12/1984 Deutsch et al. ..... 364/431.07
4,512,320 4/1985 Abe et al. .
4,523,571 6/1985 Yamato et al. ..... 123/492
4,527,529 7/1985 Suzuki et al. ..... 123/492
4,586,479 5/1986 Isomura et al. .

FOREIGN PATENT DOCUMENTS 56-148633 11/1981 Japan .
56-148634 11/1981 Japan .

*Primary Examiner*—Parshotam S. Lall
*Attorney, Agent, or Firm*—Cushman, Darby & Cushman

[57] ABSTRACT

In a fuel supply apparatus for an internal combustion engine, asynchronous fuel supply or injection is effected in addition to synchronous fuel injection so as to increase fuel amount on acceleration. In order to reduce time lag for supplying additional fuel, the opening degree and opening speed of a throttle valve of the engine are detected, and additional fuel supply by way of asynchronous fuel injection is effected whenever it is determined that the state of the throttle valve represents a state where fuel increase is required. Asynchronous fuel supply is then stopped when the opening degree of the throttle valve reaches an upper limit determined by the detected opening speed of the throttle valve, thereby avoiding application of excessively rich mixture.

14 Claims, 11 Drawing Figures

APPARATUS AND METHOD FOR CONTROLLING FUEL SUPPLY TO INTERNAL COMBUSTION ENGINE

RELATED APPLICATIONS

This application is related to co-pending, commonly assigned, applications of Abe et al., U.S. Ser. No. 590,051, filed Mar. 15, 1984 which issued Apr. 23, 1985, as U.S. Pat. No. 4,512,320, and of Isomura et al., U.S. Ser. No. 596,593, filed Apr. 4, 1984 which issued May 6, 1986 as U.S. Pat. No. 4,586,479.

BACKGROUND OF THE INVENTION

This invention relates generally to apparatus for controlling fuel supply to internal combustion engines, and more particularly to such apparatus which is capable of correcting the amount of fuel injected into engine cylinders on acceleration.

The amount of fuel to be injected into engine cylinders on acceleration is required to be larger than that on normal operation of the engine. In conventional fuel supply apparatus for internal combustion engines, therefore, the difference between necessary amount of fuel and normal amount of fuel is calculated as an additional amount of fuel to be injected so that actual amount of fuel to be injected equals the necessary amount of fuel. However, there is a time lag in fuel supply due to various factors, such as a time duration between the detection of engine parameters and computation of the amount of fuel to be injected by way of a control unit, a time duration between an instant of command of fuel increase and an instant of actual fuel injection. For instance, in the case of a system of simultaneous injection to all the cylinders once per revolutions, there is a cylinder to which fuel is injected after intake stroke, and therefore there occurs delay in fuel supply till a subsequent intake stroke. Owing to such time lag the amount of fuel to be injected cannot accurately follow the variation in the amount of intake air resulting in excessively lean air/fuel ratio which leads to a phenomenon such as backfire.

One approach for resolving the above problem is disclosed in Japanese patent provisional publication No. 56-148633. According to the technique disclosed in the above publication, a fuel correction apparatus for EFI engine is provided where the apparatus comprises a unit for determining basic fuel injection time duration on the basis of at least two engine parameters among engine speed, throttle valve opening degree, intake vacuum and so on, a unit for injecting fuel under given pressure by opening nozzles for the above basic fuel injection time duration, a unit for obtaining increasing rate of the throttle valve opening degree, and a unit for additionally injecting fuel by temporarily opening the nozzles for a given period of time when the above-mentioned increasing rate exceeds a first setting value. In other words, when the opening speed of the the throttle valve is above a setting value, an additional fuel injection which is different from normal fuel injection synchronized with engine rotation is effected so as to correct the amount of fuel injected into engine cylinders.

However, the above-mentioned setting value is constant, and cannot be changed depending on the engine operating condition. Therefore, when the operating condition suddenly varies, such that the opening speed of the throttle valve varies, it is necessary to inject the above-mentioned additional fuel with the throttle valve opening degree being detected at an interval of a short period of time of 10 to 20 ms. Furthermore, when the opening speed is around a critical value, above which additional fuel supply is effected, additional fuel injection is performed many times (such as 6 to 8 times) resulting in excessively rich air/fuel mixture. As a result, there occurs a problem of the increase in noxious components in the exhaust gases.

SUMMARY OF THE INVENTION

The present invention has been developed in order to remove the above-described drawbacks inherent to the conventional apparatus for controlling fuel amount supplied to an internal combustion engine.

It is, therefore, an object of the present invention to provide a new and useful apparatus and method for controlling fuel amount supplied into engine cylinders.

According to a feature of the present invention fuel amount is accurately controlled in accordance with the throttle valve opening degree and the opening speed thereof so that the engine is prevented from receiving excessively rich air/fuel mixture thereby increasing accelerating characteristic and improving exhaust gas nature.

More specifically, in a fuel supply apparatus for an internal combustion, asynchronous fuel supply or injection is effected in addition to synchronous fuel injection so as to increase fuel amount on acceleration. In order to reduce time lag for supplying additional fuel, the opening degree and opening speed of a throttle valve of the engine are detected, and additional fuel supply by way of asynchronous fuel injection is effected whenever it is determined that the state of the throttle valve represents a state where fuel increase is required. Asynchronous fuel supply is then stopped when the opening degree of the throttle valve reaches an upper limit determined by the detected opening speed of the throttle valve, thereby avoiding application of excessively rich mixture.

BRIEF DESCRIPTION OF THE DRAWINGS

The object and features of the present invention will become more readily apparent from the following FIG. 1. is a schematic view of apparatus according to the present invention.

The same or corresponding elements and parts are designated at like reference numerals throughout the drawings.

DETAILED DESCRIPTION OF THE INVENTION

Figure 1:
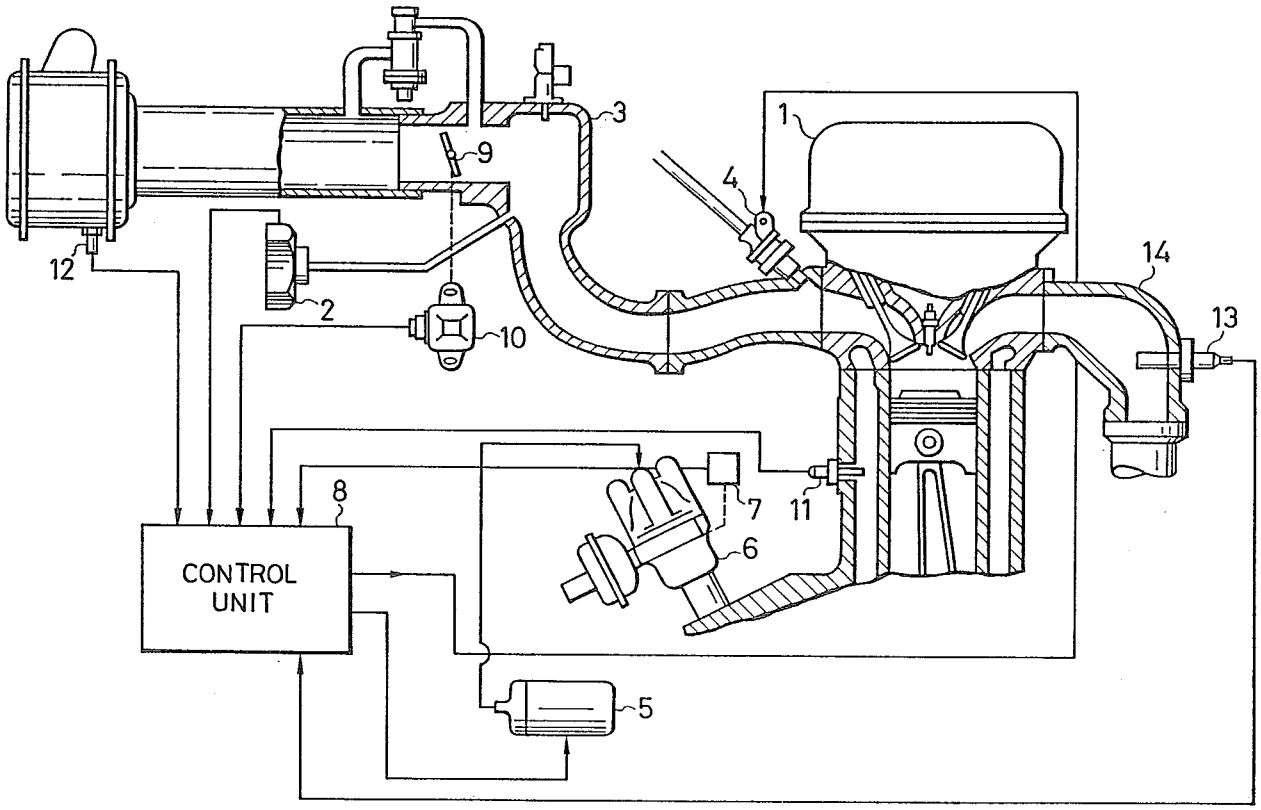

Referring now to FIG. 1, a schematic view of an electronic fuel injection apparatus for an internal combustion engine according to the present invention is shown. In FIG. 1, the reference 1 designates a 6-cylinder engine. An intake manifold pressure sensor 2 is provided for detecting intake air pressure within an intake manifold 3. Fuel injection valves 4 of electromagnetic type are provided to the intake manifold 3 of the engine 1 at a place close to intake port of respective cylinders. Fuel is sent to the fuel-injection valves 4 with pressure being regulated. The reference 5 indicates an ignition coil forming a part of ignition system including a distributor 6 which distributes ignition energy to respective spark plugs (not shown) of respective cylinders. The distributor 6 is of the type arranged to make a full turn per two revolutions of the engine crankshaft as is well known, and comprises a rotational angle detector 7 which detects the rotational angle of the engine crankshaft. The reference 8 is a control unit comprising a microcomputer.

The reference 9 is a throttle valve of the engine 1, and the reference 10 is a throttle valve sensor which detects the opening degree of the throttle valve 9. The reference 11 is a coolant temperature sensor which detects the temperature of engine coolant around the engine cylinders. The reference 12 is an intake air temperature sensor for detecting the temperature of intake air, and the reference 13 is an air/fuel ratio sensor which detects air/fuel ratio by detecting the concentration of oxygen in the exhaust gases. The air/fuel ratio sensor 13 is provided to an exhaust pipe 14, and outputs a voltage of 1 V or so when the air/fuel ratio is smaller than a stoichiometric value (when rich) and a voltage of 0.1 V or so when the air/fuel ratio is greater than the stoichiometric value (when lean).

The control unit 8 is provided for controlling the opening duration of the fuel injection valves 4 with computation or calculation of fuel amount to be injected in accordance with various detection signals from the intake pressure sensor 2, the rotational angle sensor 7, the throttle valve sensor 10, the coolant temperature sensor 11, the intake air temperature sensor 12 and the air/fuel ratio sensor 13.

In addition to the computation of the fuel injection opening time duration, optimal ignition timing is also computed using a data map prestored in a memory which will be described hereinlater so that ignition timing control is effected by sending an ignition signal to the ignition coil 5.

Figure 2:
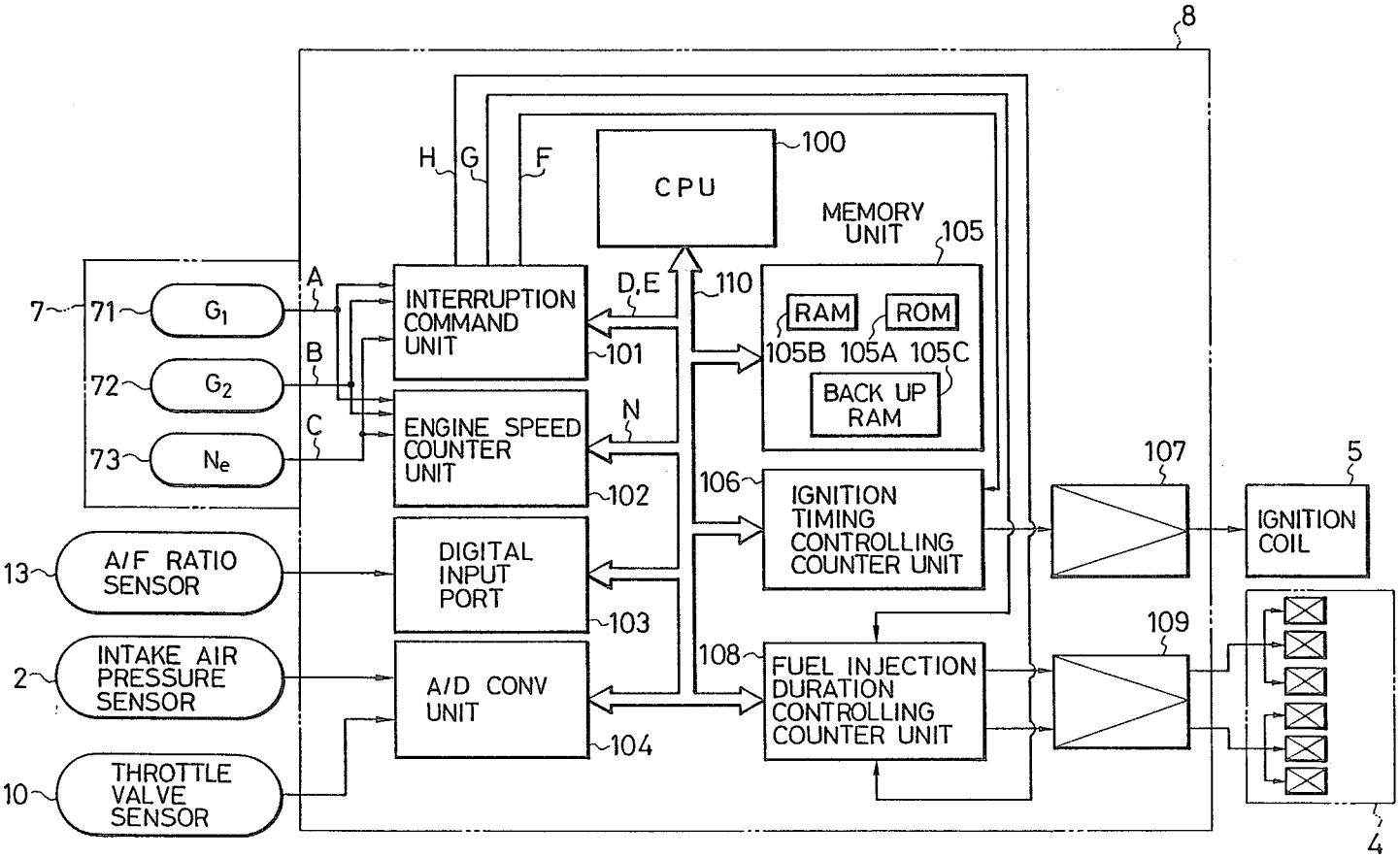
FIG. 2 is a schematic view of the control unit shown in FIG. 1.

FIG. 2 shows a schematic block diagram of the control unit 8 shown in FIG. 1. The reference 100 is a central processing unit CPU which computes basic fuel amount in accordance with intake pressure and engine speed and additional fuel amount in accordance with the opening degree and opening speed of the throttle valve 9. Since the basic fuel amount is the amount of fuel which is injected in synchronism with engine rotation, the injection of the fuel corresponding to the basic fuel amount will be referred to as synchronous fuel injection. On the other hand, the injection corresponding to the additional fuel amount will be referred to as asynchronous injection because injection of the additional fuel is effected without synchronism with the engine rotation. More specifically, asynchronous fuel supply or injection carried out for increasing fuel without time lag on acceleration is effected throughout all the cylinders regardless the state or stroke of the cylinders so that fuel is supplied as quickly as possible.

The reference 101 is an interruption command unit which produces interruption command signals. The reference 102 is a counter unit for calculating engine speed by measuring a period of a given rotational angle using a clock signal of a given frequency fed from the CPU 100. The reference 103 is a digital input port for receiving a detection signal from the air/fuel ratio sensor 13 and for transmitting the same via a data bus to the CPU 100. The reference 104 is an A/D converting unit having a multiplexer and an A/D converter for receiving analog signals from the intake air pressure sensor 2 and throttle valve sensor 10 and for converting the same into digital signals which are fed via the data bus to the CPU 100 in turn.

The reference 105 is a memory unit including a read-only memory (ROM) 105A for storing a control program for the CPU 100, a random-access memory (RAM) 105B for temporarily storing various data from various circuits or units 101, 102, 103 and 104 and other data necessary for computation. In the ROM 105A is also stored initial data. The reference 105C is a battery-backup RAM for continuously holding necessary data even if an unshown key switch is turned off.

The reference 106 is an ignition timing controlling counter unit having a register. This ignition timing controlling counter unit computes time duration and timing corresponding to engine crankshaft rotational angle using a digital signal indicative of timing of energization and deenergization of the ignition coil 5, i.e. igition timing, from the CPU 100. The reference 107 is a power amplifier responsive to an output signal from the ignition timing controlling counter unit 106 for energizing and deenergizing the ignition coil 5 thereby controlling ignition timing.

The reference 108 is a fuel injection time controlling counter unit including a register and two down counters having an identical function. Each of the down counters converts a digital signal from the CPU 100, which digital signal is indicative of the opening time duration of the fuel injection valves 4, namely the amount of fuel to be injected, into a pulse signal having a pulse width defining an opening time duration of the fuel injection valves 4. The reference 109 is a power amplifier for amplifying the pulse signal from the counter unit 108 to drive the fuel injection valves 4. The power amplifier has two channels in correspondence with the structure of the counter unit 108. The reference 110 is a common bus through which data and instructions are transmitted between various units and circuits 101 to 106 and 108. The fuel injection valves 4 are arranged to inject fuel into respective cylinders in receipt of fuel under pressure. As will be understood from the following description, the embodiments of the present invention are arranged so that fuel is supplied to all the cylinders simultaneously once per one revolution, i.e. twice per 720° CA, as synchronous fuel supply or injection. In addition fuel is also simultaneously fed to all the cylinders when necessary for increasing the amount of fuel on acceleration as asynchronous fuel supply or injection.

Figure 3:
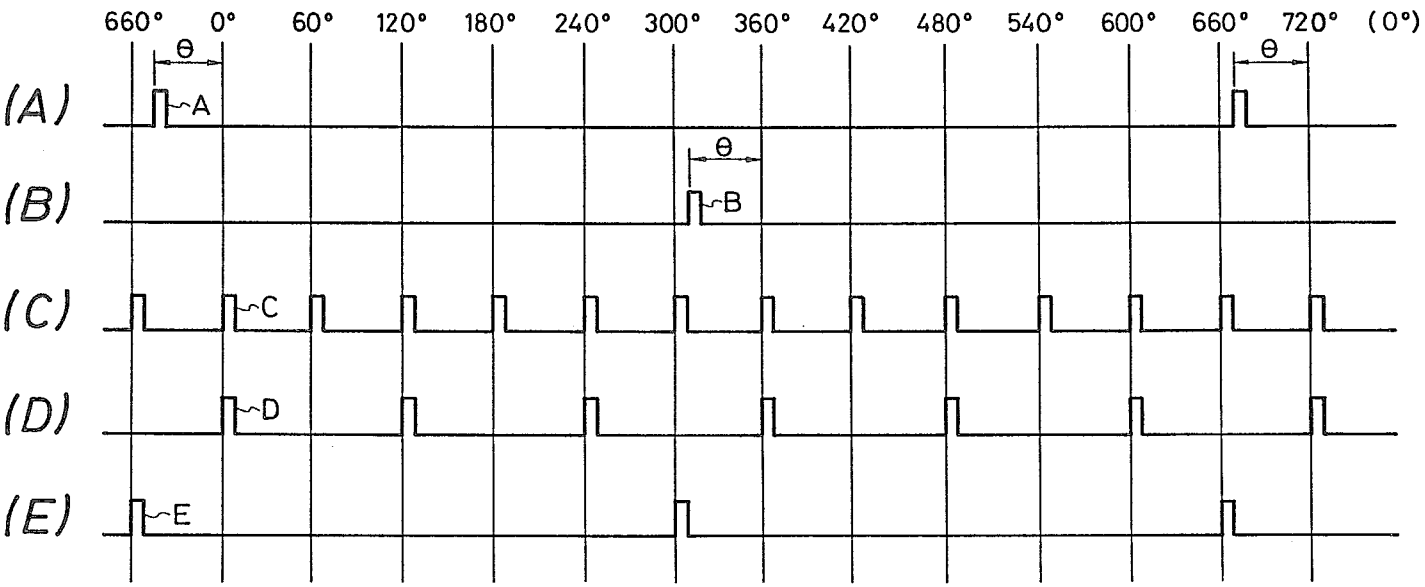
FIG. 3 is a timing chart useful for understanding the operation of the control unit of FIG. 2.

The above-mentioned rotational angle sensor 7, as shown in FIG. 2, comprises three sensors 71, 72 and 73. More specifically, the first rotational angle sensor 71 generates an angle signal A at a point $\theta$ degree before 0° CA (crank angle) once per two revolutions of the enigne crankshaft, i.e. once a revolution of the distributor 6 (see (A) in FIG. 3). The second rotational angle sensor 72 generates an angle signal B at a point $\theta$ degree before 360° CA (crank angle) once per two revolutions of the engine crankshaft (see (B) in FIG. 3). The third rotational angle sensor 73 generates an angle signal C at an interval where the number of the angle signals C per a revolution of the engine crankshaft equals the number of engine cylinders. Since the number of engine cylinders is 6 in the present embodiment, the angle signal C is generated at every 60° CA from 0° CA as shown at (C) in FIG. 3).

Output signals from these three rotational angle sensors 71 to 73 are respectively inputted to the interruption command unit 101 so that interruption for ignition timing computation and another interruption for fuel injection amount computation are commanded. A first interruption command signal for the computation of ignition timing is produced, as shown at (D) in FIG. 3, by frequency dividing the rotational angle signal from the third rotational angle sensor 73 by two and this frequency divided signal appearing immediately after the presence of the rotational angle signal A from the first rotational angle sensor 71. This interruption command signal D is sent six times per two revolutions of the engine crankshaft, i.e. the number of times per two revolutions of the engine crankshaft equals the number of engine cylinders. Accordingly, in the case of six cylinders, the interruption command signal D is sent at every 120° CA to cause the CPU 100 to execute an interrupt service routine for ignition timing computation.

The interruption command unit 101 also produces another interrupt command signal E by frequency dividing the rotational angle signal C from the third rotational angle sensor 73 by six. This interrupt command signal E is sent at every 6th pulse after the appearance of the rotational angle signal A from the first rotational angle sensor 71 or the rotational angle signal B from the second rotational angle sensor 72, i.e. every 360° CA (one revolution) starting from 300° CA. This interruption command signal E is fed to the CPU 100 to cause the same to execute another interrupt service routine for computation of fuel injection amount.

Figure 4:
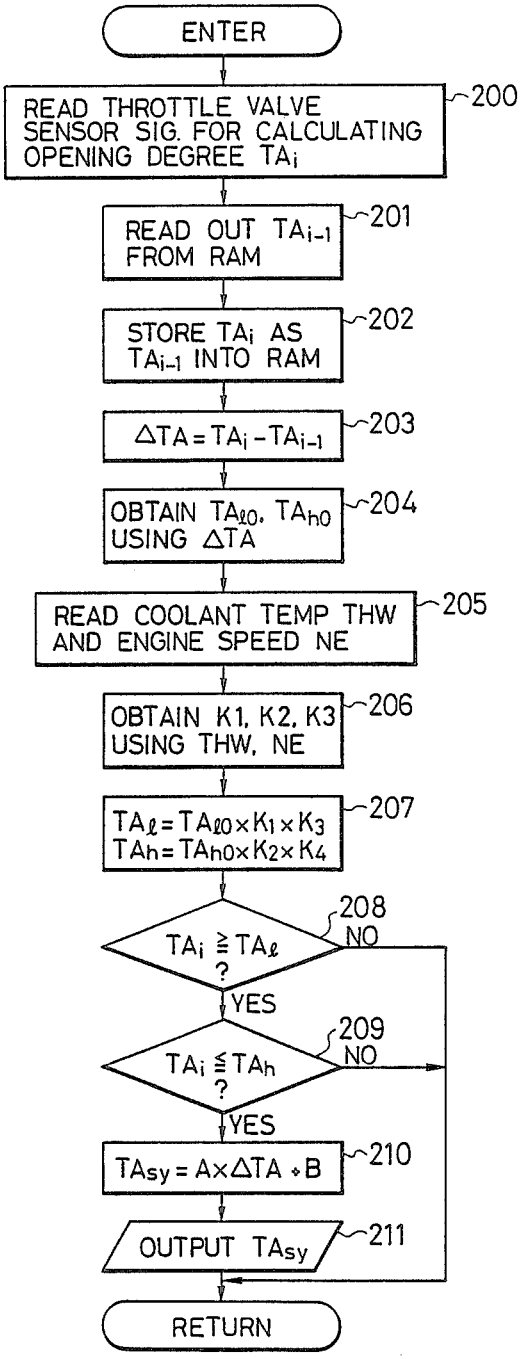
FIG. 4 is a flowchart showing the operation of the central processing unit included in the control unit of FIG. 2, describing a first embodiment of the present invention.

Now the operation for the additional fuel injection performed by the control unit 8 will be described with reference to a flowchart of FIG. 4. A control program for the additional fuel injection is executed by the CPU 100 of the control unit 100, and the control program is shown in the form of a subroutine which is periodically executed at every 20 ms as one of a plurality of routines. As the program starts, a throttle valve opening degree TAi is calculated by reading an output signal from the throttle valve sensor 10 in step 200. Then in a following step 201, a throttle valve opening degree already obtained in a former cycle of this routine is read out from a given address of the RAM 105B to be fed to the CPU 100 as TAi−1. In a following step 202, the throttle opening degree TAi obtained in the step 200 is stored in a given address of the RAM 105 as TAi−1 for an operation of a subsequent cycle. Then in a step 203, a difference ATA between the present throttle valve opening degree TAi and the former throttle valve opening degree TAi−1. Since the routine of FIG. 4 is periodically executed at every 20 ms, the difference ΔTA represents the variation of the throttle valve opening degree over 20 ms, and therefore corresponds to an opening speed of the throttle valve 9.

Figure 5:
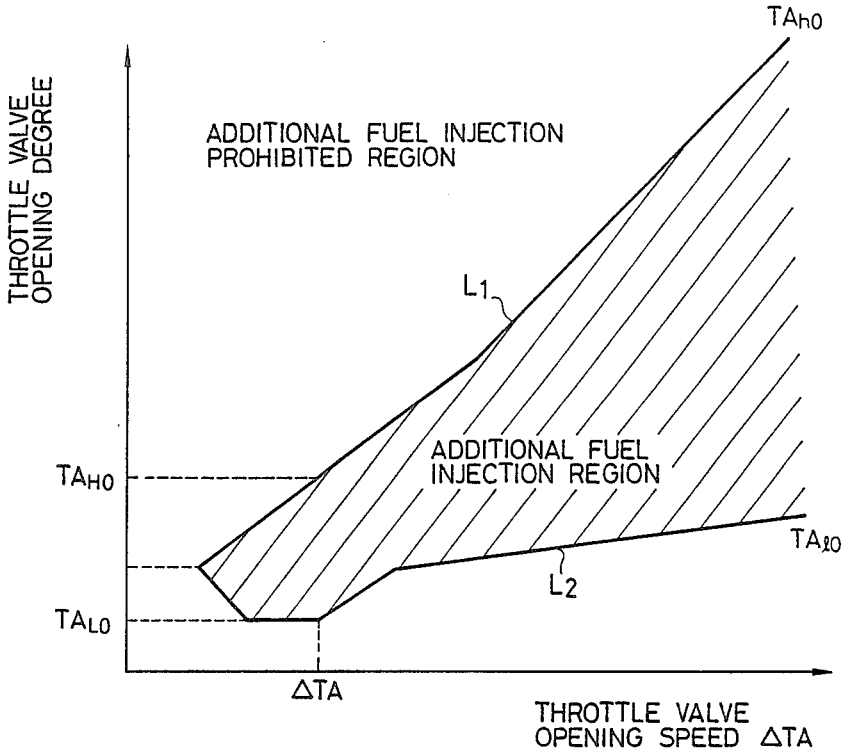
FIG. 5 is a graph showing a data map stored in a memory included in the control unit used for the first embodiment.

Then in a following step 204, basic upper limit TALO and basic lower limit TAHO of an additional fuel injection region are obtained by finding them from a data map prestored in the ROM 105A. More specifically, the above-mentioned upper and lower limits having characteristics shown in FIG. 5 are prestored as a function of the throttle valve opening degree and the opening speed ΔTA. FIG. 5 is a graph showing additional fuel injection region and additional fuel injection prohibited region which are both determined by the throttle valve opening degree and the opening speed. In FIG. 5, a hatched area between two curves L1 and L2 which are spaced apart more and more as the opening speed increases, is the additional fuel injection region in which additional fuel is to be fed to the engine cylinders, and an unhatched area corresponding to a remaining area is the additional fuel injection prohibited region where additional fuel injection is prohibited.

Figure 6:
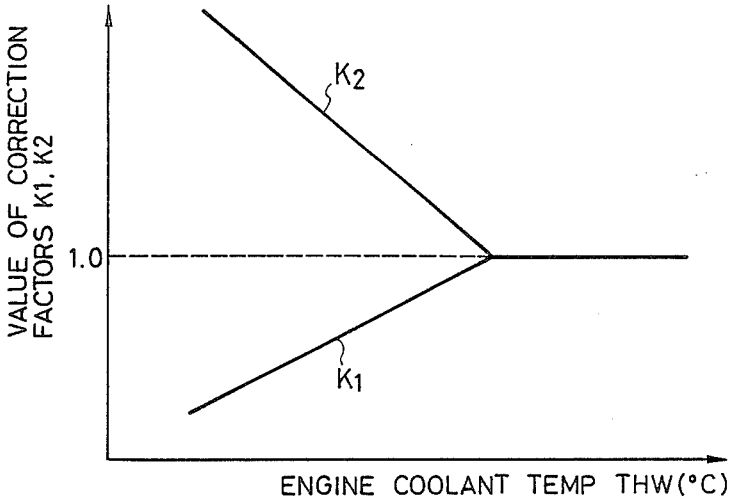
FIGS. 6 and 7 are graphs showing characteristics of correction factors K1, K2, K3 and K4 for correcting the upper and/or lower limits derived from the data map of FIG. 5.
Figure 7:
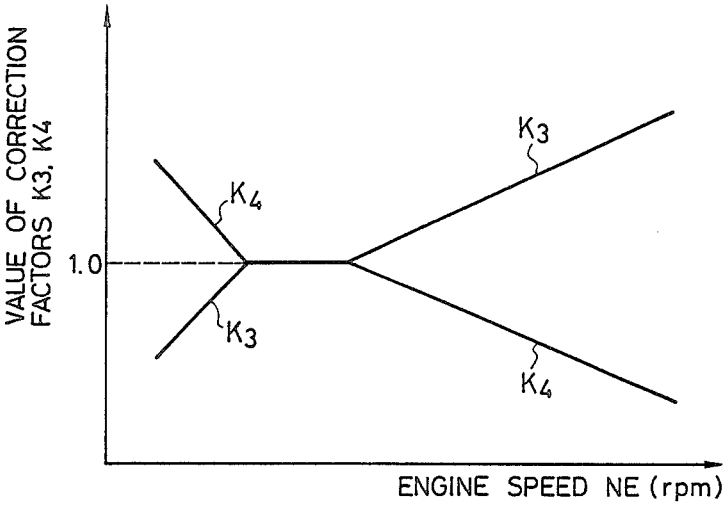

Then in following steps 205 to 207, the above-mentioned basic upper limit TAHO and the basic lower limit TALO are respectively modified or corrected in accordance with the operating condition of the engine 1. More specifically, coolant temperature THW and engine speed NE are respectively read from the output signals from the engine coolant temperature sensor 11 and the rotational angle sensor 7 in the step 205 first. Then in the step 206, first to fourth correction factors K1, K2, K3 and K4 are respectively obtained using coolant temperature THA and engine speed NE using a data map prestored in the ROM 105A. FIGS. 6 and 7 show characteristics of these correction factors K1 to K4.

The correction factors K1 and k3 are used for correcting the basic lower limit TALO, while the other correction factors K2 and K4 are used for correcting the basic upper limit TAHO. It will be understood from the relationship between FIG. 5 and FIG. 7, that as the engine speed NE becomes higher and higher, the upper limit basically determined by the curve L1 is changed to a lower value while the lower limit basically determined by the curve L2 is changed to a higher value. In other words, because of the correction of the upper and lower limits by the correction factors, the additional fuel injection region (hatched area) becomes narrow. On the other hand, when the coolant temperature is low, the upper limit basically determined by the curve L1 is changed to a larger value, while the lower limit basically determined by the other curve L2 is changed to a smaller value. As a result, the correction factors K1 to K4 are arranged so that the additional fuel injection region is widened as the coolant temperature THW is low and engine speed NE is low, and the additional fuel injection region is narrowed as the engine speed is high. With this arrangement, most suitable fuel amount can be calculated for detected engine speed NE and coolant temperature THW. Although the additional fuel injection region is corrected by the correction factors K1 to K4, this region is still defined by the two curves L1 and L2 which are spaced apart more and more as the throttle valve opening speed increases.

In the step 207, the lower limit TALO and the upper limit TAHO are corrected by the correction factors K1 to K4 as shown so as to obtain corrected lower limit TAL and corrected upper limit TAH.

Then in a step 208, the throttle valve opening degree TAi is compared with the lower limit TAL. When the actual opening degree TAi is greater than the lower limit TAL, then TAi is compared with the upper limit TAH in a step 209. If the actual throttle valve opening degree TAi is between the lower and upper limits TAL and TAH, i.e. TAL≦TAi≦TAH, a step 210 is executed to compute an additional fuel injection time duration TASY. On the other hand, when one of TAi≦TAL, TAi≧TAH is satisfied, the routine is terminated. The additional fuel injection time duration TASY is obtained as a linear function of ΔTA, and the references M and N are constants. Finally in a step 211, a signal based on the additional fuel injection time duration TASY is fed to the fuel injection valves 4 to terminate the routine.

As the additional fuel injection is effected through the execution of the routine of FIG. 4, fuel is injected into engine cylinders in addition to synchronous fuel injection thereby controlling the amount of fuel to be injected into cylinders in total. The timing of additional fuel injection may be set immediately after the computation of the fuel injection valve opening duration. However, the timing of additional fuel injection may be arbitrarily set depending on the engine operating condition. For instance, if the asynchronous fuel injection timing is overlapped with the timing of synchronous fuel injection, asynchronous fuel injection may take place immediately after the synchronous fuel injection.

Figure 8:
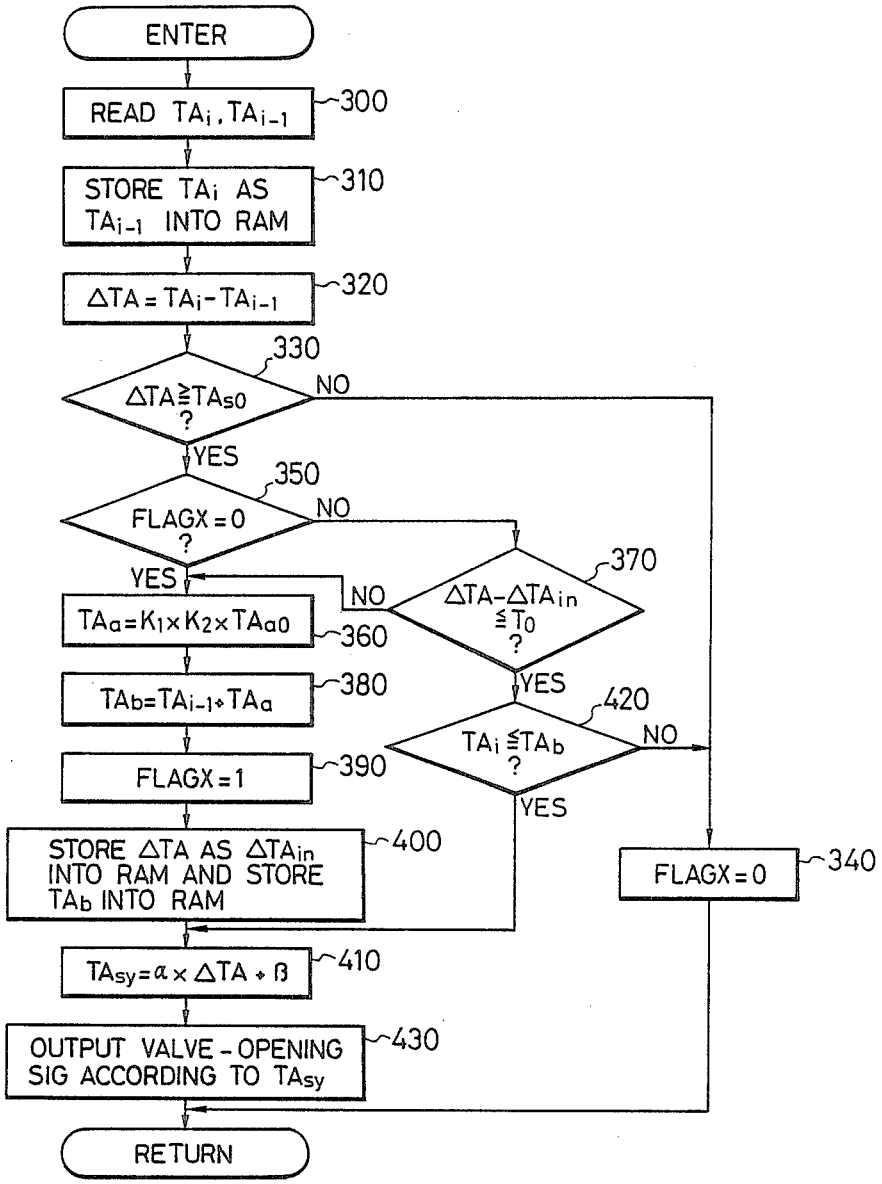
FIG. 8 is a flowchart showing the operation of the central processing unit included in the control unit of FIG. 2, describing a second embodiment of the present invention.

FIG. 8 is a flowchart showing the operation of another embodiment of the apparatus according to the present invention. A control routine shown in the flowchart is repeatedly executed at an interval of 20 ms in the same manner as the first embodiment shown in FIG. 4. As soon as power is supplied to the control unit 8 of FIG. 2, a flag FLAGX, which indicates asynchronous fuel injection, is initialized to zero. In a first step 300, a newest throttle valve opening degree TAi is read from the output signal from the throttle valve sensor 10 and a former throttle valve opening degree TAi−1 used in a former cycle of this routine is read out from a given area of the RAM of the memory unit 105. In a following step 310, the former data TAi−1 is renewed by the present data TAi of the throttle valve opening degree for the preparation for subsequent cycle of this routine. Namely, renewed data is stored in the given area of the RAM 105B. In a subsequent step 320, a difference ΔTA between the throttle valve opening degrees TAi and TAi−1 is computed. These step 300 through 320 substantially correspond to steps 200 to 203 of FIG. 4.

In a following step 330, it is determined whether the difference ΔTA indicative of the opening speed of the throttle valve 9 is greater than a predetermined value TAso. As will be understood from the following description, asynchronous fuel injection for fuel increase on acceleration is effected by watching the opening degree and opening speed of the throttle valve 9, and this predetermined value TAso represents a throttle valve opening speed below which asynchronous fuel injection is unnecessary because such low opening speed is considered to be other than accelerating condition as shown in a graph of FIG. 9. In other words, the increase in intake air quantity does not cause excessively lean air/fuel ratio, and on acceleration where lean mixture does not raise a problem it is determined that fuel increase by way of asynchronous fuel injection at the beginning of acceleration is unnecessary.

When the determination in the step 330 is NO because fuel increase by way of asynchronous fuel injection is unnecessary, then the operational flow goes to a step 340 in which the flag FLAGX is reset to zero and the operation of this routine is terminated. On the other hand, when the determination in the 330 is YES i.e. when ΔTA≧TAso, operational flow goes to a step 350 in which it is checked whether the flag FLAGX indicative of the asynchronous fuel injection equals zero or not. If FLAGX=0, it is determined that asynchronous fuel injection has not been performed in the former cycle of this routine, and the operational flow goes to a step 260. On the contrary, if FLAGX=1, then it is determined that asynchronous fuel injection has already been effected and a step 270 will be executed.

Figure 9:
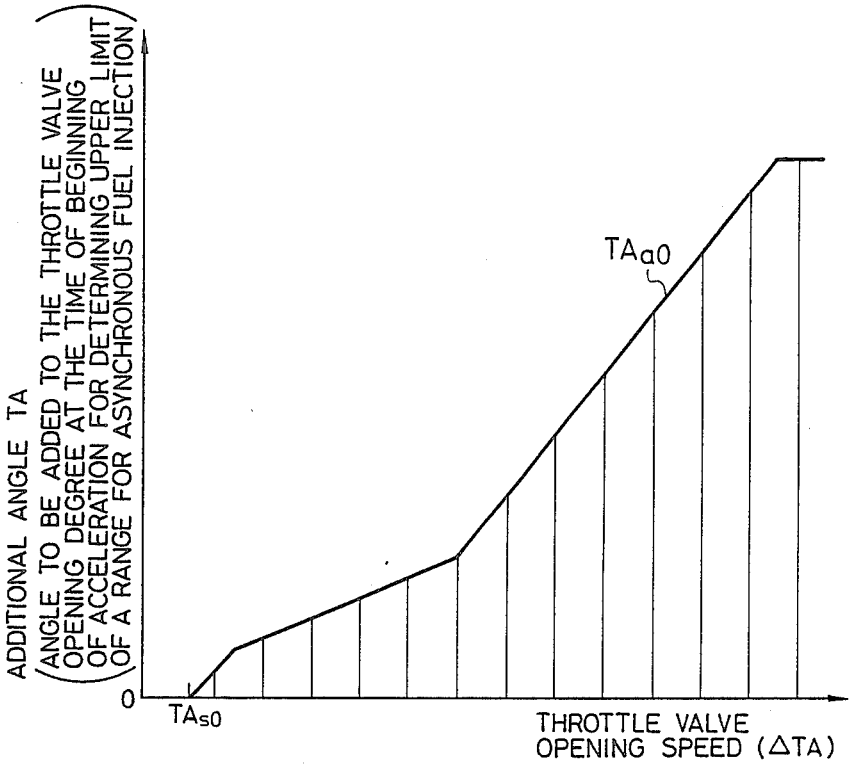
FIG. 9 is a graph showing a data map stored in a memory included in the control unit used for the second embodiment.
Figure 10:
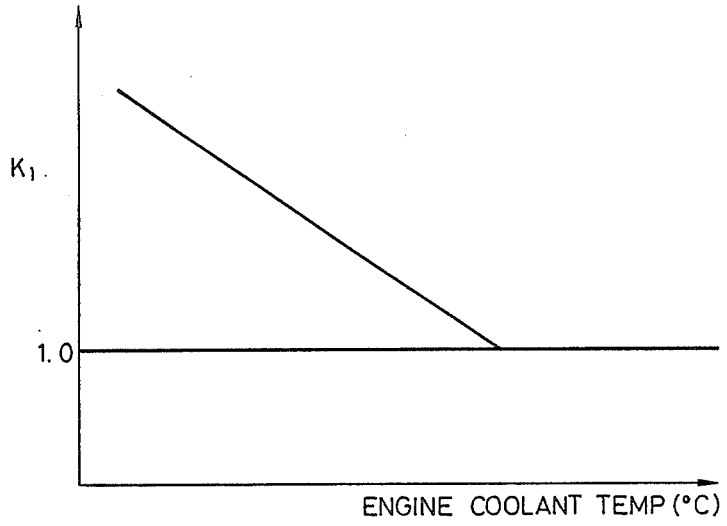
FIG. 10 and 11 are graphs showing characteristics of correction factors K1 and K2 for correcting the additional angle derived from the data map of FIG. 9.
Figure 11:
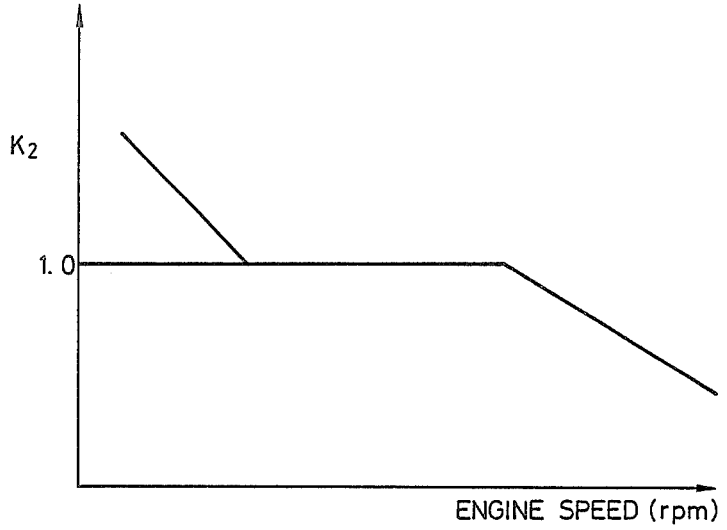

Describing the steps 360 et seq. first, in the step 360, an additional angle TA is obtained from a graph of FIG. 9 in accordance with the present throttle valve opening speed ΔTA. This additional angle TA is an angle to be added to the throttle valve opening degree TAi at the time of beginning of acceleration for determining an upper limit of a range for asynchronous fuel injection. In other words, this additional angle TA provides a basic range of asynchronous fuel injection as will be described in detail hereinlater. The data or curve of the additional angle TA of the graph of FIG. 9 is prestored in the form of a data map in the ROM 105A. The additional angle TAao is then multiplied by constants K1 and K2 to be corrected in accordance with engine operating condition. While the additional angle TAao is predetermined such that it increases along the increase in the throttle valve opening speed ΔTA as shown by the curve in FIG. 9, actual values thereof are determined through experiments so as to be suitable for each engine to be controlled.

The above-mentioned constants K1 and K2 used for calculating TAa are correction factors for correcting the range of throttle valve opening degree where fuel increase by asynchronous fuel injection is to be effected from the beginning of acceleration in accordance with the state of the engine 1. FIGS. 8 and 9 show examples of these correction factors K1 and K2. In detail, the first correction factor K1 is a function of engine coolant temperature indicative of the warming up condition of the engine 1, and the second correction factor K2 is a function of engine speed.

In a following step 380, the former throttle opening degree TAi−1 read in the step 300 is added to the corrected additional angle TAa just obtained in the step 360 so as to obtain a sum TAb. This sum TAb provides an upper limit of a range of throttle opening degree where fuel increase by way of asynchronous fuel injection is effected during acceleration. In a following step 390, the flag FLAGX is set to 1, and in a following step 400 the throttle valve opening speed ΔTA obtained in the step 320 is stored in a given area of the memory unit 105 as ΔTAin and the upper limit TAb obtained in the step 380 is also stored similarly. After completion of the step 400, the operational flow goes to a step 410 which will be described hereinlater.

Turning back to the step 350, when the determination in the step 350 is NO, namely, when FLAG=1, a step 370 is executed to check whether ΔTA−ΔTAin≦To. Here, ΔTA is the throttle valve opening speed obtained in the step 320 at the time of the execution of this routine, and ΔTAin is the throttle valve opening speed in the former cycle of this routine (i.e. opening speed stored in the given area of the memory unit 105 in the step 400 of the former cycle). Thus, in the step 370, it is checked whether the difference between ΔTA and ΔTAin is smaller than a predetermined value To or not. If the determination in the step 370 is NO, namely, when the present throttle valve opening speed ΔTA is greater than the former opening speed ΔTAin by a given amount, it means that the opening speed of the throttle valve 9 is becoming faster and faster, and therefore, it is considered that further acceleration is required. For this reason, when the determination in the step 370 is NO, the step 360 is executed for setting an upper limit TAb of the throttle opening degree where fuel increase by asynchronous fuel injection is effected. In the case that the determination in the step 370 is YES because the throttle valve opening speed does not change very much, the operational flow goes to a step 420 in which it is checked whether the present throttle valve opening degree TAi is smaller than the upper limit TAb stored in the given area of the memory unit 105 after being obtained in the step 380 of the former cycle. If the relationship of TAi≦TAb is satisfied, it is determined that the throttle valve opening degree does not exceed the upper limit of the throttle valve opening degree where asynchronous fuel injection is to be effected, and then the operational flow goes to the step 410. On the other hand, if the determination in the step 420 is NO, namely, when TAi≦TAb is not satisfied i.e. TA>TAb, it is determined that the throttle valve opening degree TAi has exceeded the range where asynchronous fuel injection is to be effected, and then the operational flow goes to the step 340. As a result, the flag FLAGX is reset to zero and the operation of this routine is terminated.

In the step 410, the amount TAsy of fuel to by injected by the asynchronous fuel injection is computed in accordance with the throttle valve opening speed ΔTA. It will be understood that the step 410 is executed for performing asynchronous fuel injection for the first time or when the throttle valve opening degree is still below the upper limit thereof where asynchronous fuel injection is to be effected even after asynchronous fuel injection is carried out. The asynchronous fuel injection amount TAsy is obtained as $TAsy=\alpha\times\Delta TA+\beta$ wherein $\alpha$ and $\beta$ are constants determined by the characteristics of the intake air pressure sensor 2 including response time lag or the like. In a following step 430, a value corresponding to a valve opening time duration for which the fuel injection valves 4 are opened is set in the fuel injection time duration controlling counter unit 108 in accordance with the asynchronous fuel injection amount TAsy obtained in the step 410. The counter unit 108 starts counting down when data is set therein so as to open the fuel injection valves 4 until the count reaches zero via the power amplifier 109. As a result, fuel injection is effected without synchronism with engine rotation to increase the amount of fuel. After the step 430 is completed, the operation of this routine is terminated.

Summarizing the second embodiment, the opening speed ΔTA of the throttle valve 9 is detected by reading the opening degree TAi thereof at an interval of 20 ms, and when the opening speed ΔTA is above a predetermined value, the range TAb of the throttle opening degree where asynchronous fuel injection is effected is computed using a prestored data map, and when the actual throttle opening degree TAi is within the obtained range TAb, fuel amount TAsy to be injected into engine cylinders is determined in accordance with the opening speed ΔTA of the throttle valve 9 thereby increasing fuel amount with asynchrononous fuel injection. Accordingly, since asynchronous fuel injection is carried out only when the throttle valve opening degree is below a predetermined value determined in accordance with the opening speed thereof from the beginning of acceleration, a problem of excessively lean mixture due to response time lag of the intake air pressure sensor 2 which detects intake air quantity can be effectively resolved, and thus satisfactory drivability can be ensured even at a period immediately after the beginning of acceleration. In addition, since fuel injection is effected without synchronism with engine rotation immediately after the detection of the beginning of acceleration through the variation of the throttle valve opening degree, a problem that fuel increase is not performed until subsequent synchronous fuel injection. As a result, deterioration in drivability due to excessively lean mixture caused from such time lag can be effectively avoided.

While in the above described embodiments intake air pressure sensor is used for detecting the quantity of intake air, the present invention may be satisfactorily used for an internal combustion engine using an airflow meter since there is a response time lag due to inertia in an airflow meter so that similar effects are resulted. Although the embodiments have been described taking examples of 6-cylinder engine, the present invention may be adapted to other multi-cylinder engines such as 4-cylinder, 8-cylinder and so on. Furthermore, the present invention may be adapted to a multi-cylinder engine in which fuel injection is effected for each cylinder separately. Moreover, the present invention can be adapted to other fuel supply system of a multi-cylinder engine other than fuel injection apparatus.

In the second embodiment although the throttle opening degree where asynchronous fuel injection is to be effected is obtained on the basis of the opening speed of the throttle valve and is corrected by correction factors K1 and K2 which are functions of engine coolant temperature and engine speed, the throttle valve opening degree may be corrected by a present opening degree of the throttle valve and/or gear position in a transmission associated with the engine 1. When gear position of the transmission is used as a factor for effecting correction, the drivability during acceleration can be effectively maintained since fuel amount to be increased by the asynchronous fuel injection is changed in accordance with output torque to be derived from the engine.

What is claimed is:

1. Apparatus for controlling fuel supply to an internal combustion engine, said apparatus being arranged to supply said engine with fuel in synchronism with engine rotation, comprising:

(a) first means for detecting opening degree of a throttle valve of said engine;

(b) second means for detecting opening speed of said throttle valve;

(c) third means responsive to said first and second means for determining, in a two-dimensional map, an additional fuel supply region in which additional fuel is to be supplied to said engine, in accordance with said opening speed such that a distance between an upper and lower limits in opening degree of said throttle valve monotonically increases as said opening speed increases, and for determining whether a value obtained as a function of said opening degree and opening speed is within said additional fuel supply region or not; and (d) fourth means responsive to said third means for supplying said engine with fuel separately from the synchronous fuel supply.

2. Apparatus as claimed in claim 1, wherein said third means comprises a memory means for storing data map of said additional fuel supply region as function of said opening speed of said throttle valve.

3. Apparatus as claimed in claim 1, wherein said additional fuel supply region is defined by two curves which are spaced more and more as said opening speed increases.

4. Apparatus as claimed in claim 1, wherein said third means comprises a memory means for storing data map of additional angle as function of said opening speed of said trottle valve, said additional angle being added to said opening degree of said throttle valve to provide said additional fuel supply region.

5. Apparatus as claimed in claim 1, further comprising means for detecting engine coolant temperature, means for detecting engine speed and means for correcting said lower and upper limits in accordance with an engine coolant temperature and an engine speed respectively detected.

6. Apparatus as claimed in claim 5, wherein said means for correcting said lower and upper limits is arranged to widen said additional fuel supply region defined between said lower and upper limits as said coolant temperature drops and as said engine speed drops, and to narrow said additional fuel supply region as said engine speed rises.

7. A method for controlling fuel supply to an internal combustion engine equipped with apparatus for supplying fuel in synchronism with engine rotation, comprising the steps of:

(a) detecting opening degree of a throttle valve of said engine;

(b) detecting opening speed of said throttle valve;

(c) determining, in a two-dimensional map, upper and lower limits of opening degree of said throttle valve in which additional fuel is to be supplied to said engine, in accordance with said opening speed such that a distance between said upper and lower limits monotonically increases as said opening speed increases;

(d) determining whether a value obtained as a function of said opening degree and opening speed is within an area defined by said upper and lower limits or not; and (e) supplying said engine with fuel separately from the synchronous fuel supply when said opening degree is between said upper and lower limits.

8. A method as claimed in claim 7, further comprising a step of correcting said upper and/or lower limits using one or more engine parameters.

9. A method as claimed in claim 7, further comprising a step of correcting said upper and/or lower limits using one or more operating parameters of a vehicle on which said engine is mounted.

10. A method as claimed in claim 7 further comprising a step of determining time duration for fuel supply as a linear function of said opening speed.

11. A method for controlling fuel supply to an internal combustion engine equipped with apparatus for supplying fuel in synchronism with engine rotation, comprising the steps of:

(a) detecting opening degree of a throttle valve of said engine;

(b) detecting opening speed of said throttle valve;

(c) determining whether said opening speed of said throttle valve is above a predetermined value or not;

(d) obtaining an additional angle as a function of said opening speed of said throttle valve;

(e) adding said additional angle to said opening degree of said throttle valve for obtaining, in a two-dimensional map, an additional fuel supply region in which additional fuel is to be supplied to said engine, said additional fuel supply region being defined by upper and lower limits such that a distance between said upper and lower limits monotonically increases as said opening speed increases;

(f) determining whether a value obtained as a function of said opening degree and opening speed is within said additional fuel supply region or not; and (g) supplying said engine with fuel separately from the synchronous fuel supply when said opening degree is within said additional fuel supply region.

12. A method as claimed in claim 11, further comprising a step of correcting said additional angle using one or more engine parameters.

13. A method as claimed in claim 11, further comprising a step of correcting said additional angle using one or more operating parameters of a vehicle on which said engine is mounted.

14. A method as claimed in claim 11, further comprising a step of determining time duration for fuel supply as a linear function of said opening speed.

* * * * *